US010882335B2

(12) United States Patent
Ebihara

(10) Patent No.: US 10,882,335 B2
(45) Date of Patent: Jan. 5, 2021

(54) LIQUID COATING DEVICE, LIQUID-COATING CONVEYANCE APPARATUS, IMAGE FORMING APPARATUS, AND IMAGE FORMING SYSTEM

(71) Applicant: Takashi Ebihara, Kanagawa (JP)

(72) Inventor: Takashi Ebihara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/286,174

(22) Filed: Feb. 26, 2019

(65) Prior Publication Data

US 2019/0270319 A1 Sep. 5, 2019

(30) Foreign Application Priority Data

Mar. 1, 2018 (JP) ..... 2018-036970

(51) Int. Cl.
*B41J 29/38* (2006.01)
*B41J 11/00* (2006.01)
*B41M 5/50* (2006.01)

(52) U.S. Cl.
CPC ..... *B41J 11/0015* (2013.01); *B41J 29/38* (2013.01); *B41M 5/508* (2013.01)

(58) Field of Classification Search
CPC ..... B41J 29/38; B41J 11/0015; B41M 5/506
See application file for complete search history.

(56) References Cited

U.S. PATENT DOCUMENTS

| | | | |
|---|---|---|---|
| 2014/0146108 | A1 | 5/2014 | Ebihara |
| 2015/0346659 | A1 | 12/2015 | Nagayama et al. |
| 2016/0167401 | A1 | 6/2016 | Ebihara et al. |

FOREIGN PATENT DOCUMENTS

| | | |
|---|---|---|
| JP | 2005-077684 | 3/2005 |
| JP | 2012-061414 | 3/2012 |
| JP | 2014-058118 | 4/2014 |

*Primary Examiner* — Lamson D Nguyen
(74) *Attorney, Agent, or Firm* — Duft & Bornsen, PC

(57) ABSTRACT

A liquid coating device includes a coating roller, a supply roller, a pressure roller, a first separator, a second separator, and a sheet receiver. The coating roller coats a sheet with liquid. The supply roller supplies the liquid to the coating roller. The pressure roller sandwiches the sheet, together with the coating roller. The first separator separates the sheet coated with the liquid, from the coating roller. The second separator separates, from the supply roller, a sheet that has not been separated by the first separator and has reached the supply roller. The sheet receiver forms a storage space to accommodate at least a portion of the sheet that has been separated from the supply roller by the second separator.

20 Claims, 12 Drawing Sheets

LIQUID COATING DEVICE, LIQUID-COATING CONVEYANCE APPARATUS, IMAGE FORMING APPARATUS, AND IMAGE FORMING SYSTEM

CROSS-REFERENCE TO RELATED APPLICATION

This patent application is based on and claims priority pursuant to 35 U.S.C. § 119(a) to Japanese Patent Application No. 2018-036970, filed on Mar. 1, 2018, in the Japan Patent Office, the entire disclosure of which is incorporated by reference herein.

BACKGROUND

Technical Field

The present disclosure relates to a liquid coating device, a liquid-coating conveyance apparatus, an image forming apparatus, and an image forming system.

Related Art

An image forming system is known that includes: a liquid coating device to coat a recording medium with liquid; and an image forming apparatus disposed at a stage subsequent to the liquid coating device so as to perform image formation on the recording medium coated with the liquid. The liquid coating device uses a roller-shaped member (coating roller) to coat a recording medium with liquid. The recording medium is conveyed while being in contact with the coating roller, and then the recording medium coated with liquid is conveyed to the image forming apparatus. To prevent the recording medium from being wound around the coating roller, the liquid coating device includes a mechanism to separate the recording medium from the roller at a position downstream of the coating roller in a direction of conveyance of the recording medium.

SUMMARY

In an aspect of the present disclosure, there is provided a liquid coating device that includes a coating roller, a supply roller, a pressure roller, a first separator, a second separator, and a sheet receiver. The coating roller coats a sheet with liquid. The supply roller supplies the liquid to the coating roller. The pressure roller sandwiches the sheet, together with the coating roller. The first separator separates the sheet coated with the liquid, from the coating roller. The second separator separates, from the supply roller, a sheet that has not been separated by the first separator and has reached the supply roller. The sheet receiver forms a storage space to accommodate at least a portion of the sheet that has been separated from the supply roller by the second separator.

In another aspect of the present disclosure, there is provided a liquid-coating conveyance apparatus that includes the liquid coating device to coat the sheet with the liquid and a conveyance device to feed the sheet into the liquid coating device and convey the sheet coated with the liquid.

In still another aspect of the present disclosure, there is provided an image forming system that includes an image forming apparatus to form an image on a sheet and the liquid coating device to coat the sheet with the liquid.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
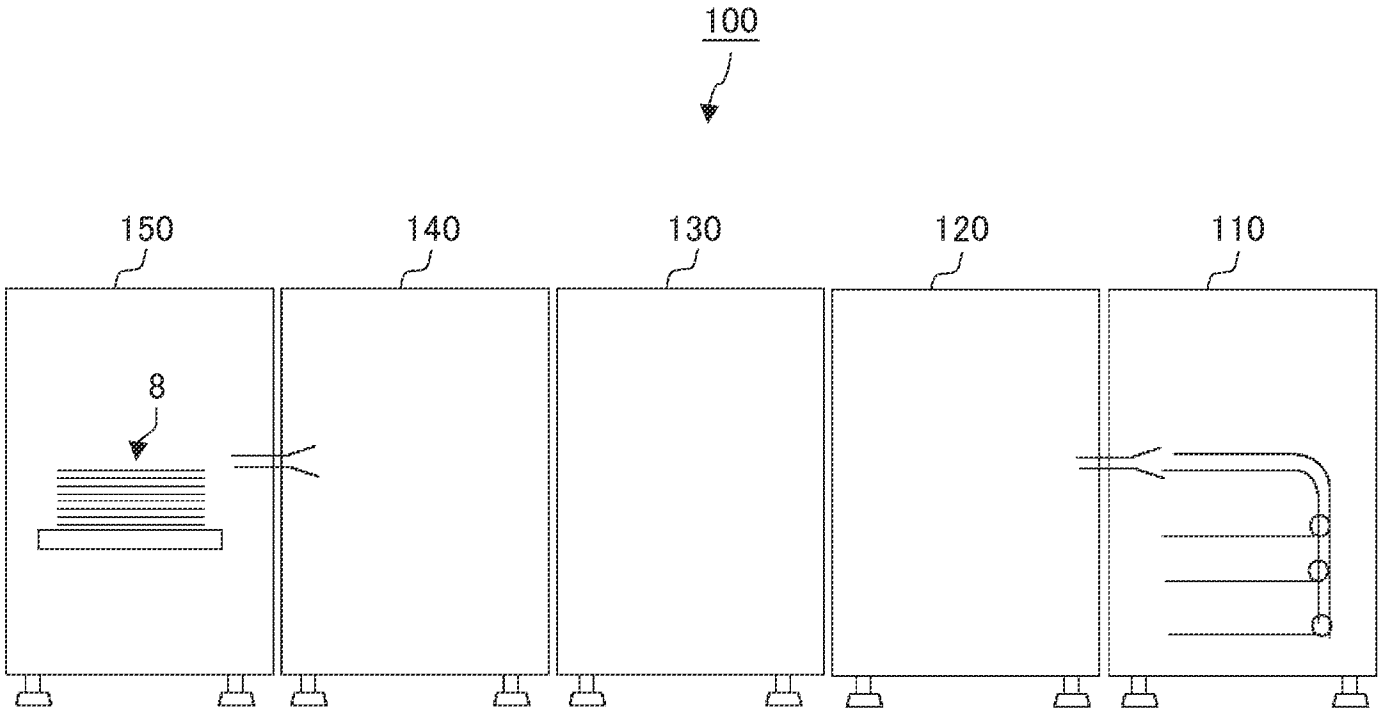
FIG. 1 is a system configuration diagram of a print system as an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a liquid coating device, a liquid-coating conveyance apparatus, an image forming apparatus, and an image forming system according to embodiments of the present disclosure will be described with reference to the drawings. Since the embodiments described below are example embodiments of the present disclosure, various technically preferable limitations are added. The scope of the present invention, however, is not unduly limited by the following description, and all of the configurations described in the following embodiments are not indispensable constituent features of the present invention.

First, an image forming system according to an embodiment of the present disclosure will be described. As illustrated in FIG. 1, a print system 100 as the image forming system according to the present embodiment includes a feeder 110, a pretreatment liquid coater 120, a printer 130, a dryer 140, and a medium ejector 150. The pretreatment liquid coater 120 corresponds to a liquid-coating conveyance apparatus according to an embodiment of the present disclosure.

The feeder 110 supplies a sheet-shaped recording medium to the pretreatment liquid coater 120 provided downstream of a conveyance path. An example of the sheet-shaped recording medium supplied from the feeder 110 is a cut sheet. Hereinafter, the sheet-shaped recording medium will be denoted as a "sheet 8" in the description of the present embodiment.

The pretreatment liquid coater 120 includes: a coating device 12 to coat the sheet 8 with a liquid having effects of improving image quality such as ink bleed prevention and penetration assistance; and a conveyance device including conveyance rollers 70 to convey the liquid-coated sheet 8 toward the printer 130 as an image forming apparatus. Note that reference numerals of the conveyance roller 70 are partially illustrated in FIG. 2. The coating device 12 corresponds to the liquid coating device according to an embodiment of the present disclosure. The details of the coating device 12 will be described below. Further, in the present embodiment, the liquid to be coated on the sheet 8 in the pretreatment liquid coater 120 will be denoted as a "pretreatment liquid 7".

Figure 2:
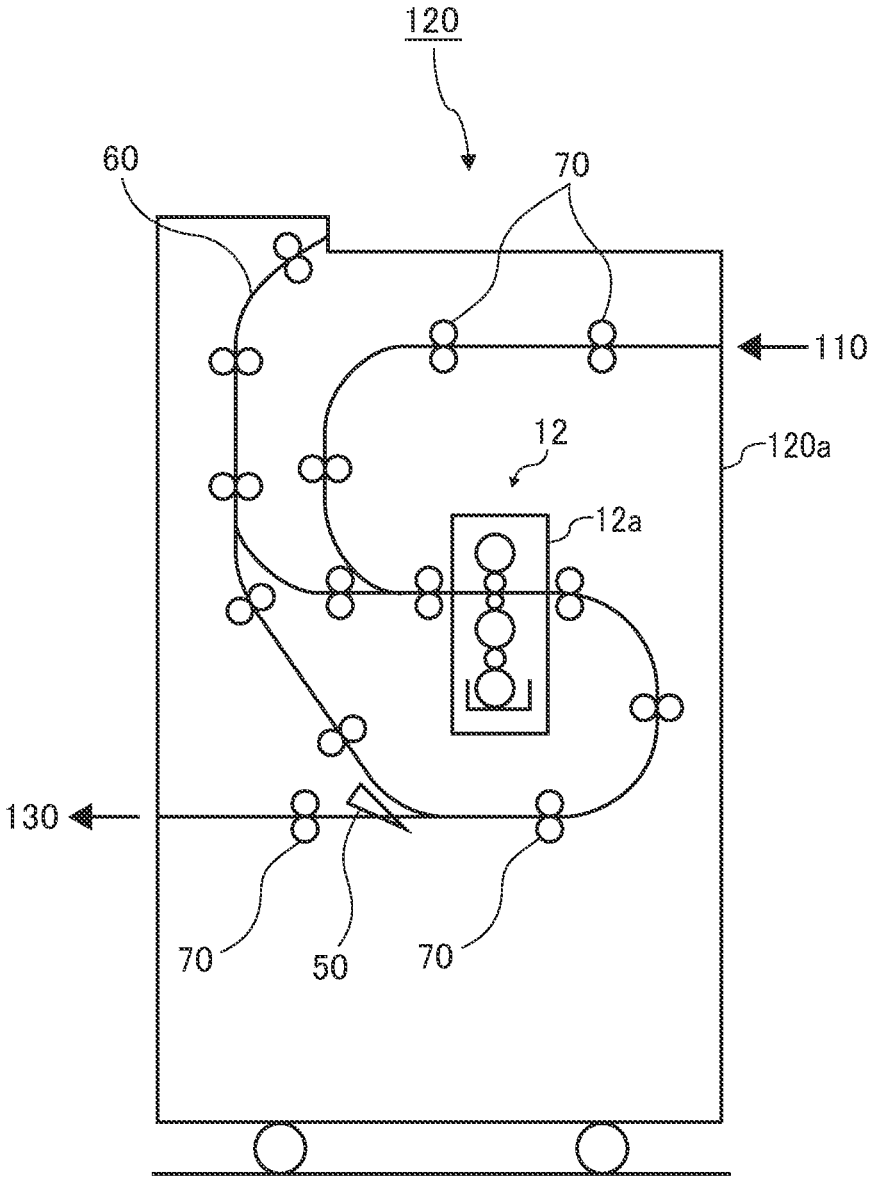
FIG. 2 is a configuration diagram illustrating an internal structure of a liquid-coating conveyance apparatus according to an embodiment of the present disclosure.

As illustrated in FIG. 2, the pretreatment liquid coater 120 includes: a reverse path 60; a branch path 50 forming a branch for conveying the sheet 8 to the reverse path 60; and the conveyance rollers 70. In the case of coating both sides of the sheet 8 with the pretreatment liquid 7, the pretreatment liquid 7 is first applied to one side (front side) of the sheet 8, and then, the sheet 8 is conveyed to the reverse path 60 via the branch path 50 so as to be reversed. The reversed sheet 8 is again fed through the coating device 12 so as to allow the pretreatment liquid 7 to be also applied to the other surface (back side). As described above, the sheet 8 having both sides coated with the pretreatment liquid 7 is transferred through the branch path 50 to be conveyed to the printer 130.

The printer 130 corresponds to an image forming apparatus that includes an image forming device 135 to discharge ink droplets to perform image formation on the sheet 8 coated with the pretreatment liquid 7 by the pretreatment liquid coater 120.

The dryer 140 dries an image formed by the printer 130, on the front side of the sheet 8. In the case of printing on the front and back sides of the sheet 8, the sheet 8 is reversed by a return path from the dryer 140 to the printer 130, and then, ink droplets are ejected on the front side (the back side before reversal) of the sheet 8 that has been front/back reversed by the printer 130 so as to form a desired image. Thereafter, the image on the front side (the back side before reversal) of the sheet 8 is dried by the dryer 140. Thereafter, the sheet 8 is discharged to the medium ejector 150.

Note that the image forming apparatus integrating the functions of the above-described individual apparatuses inside the printer 130 corresponds to the image forming apparatus according to an embodiment of the present disclosure. In that case, structures of the above-described individual devices are mutually different in terms of size and details, while the main functions are equivalent.

An example of the image forming system and the image forming apparatus according to embodiments of the present disclosure is a liquid ejection recording system. The embodiments described in the present specification are also described based on the example of the liquid ejection recording system. The print system 100 according to the present embodiment includes a recording head (liquid ejection head) for ejecting ink, and allows the ink to be ejected from the recording head toward a medium to be conveyed so as to form an image on the medium. For example, examples of the print system 100 correspond to: a serial type inkjet printer that ejects ink droplets to form an image while the liquid ejection head moves in a main scanning direction; and a line type inkjet printer having a line-type head that ejects ink droplets to form an image with no movement of the liquid ejection head.

In the present embodiment, the term "medium" refers to the sheet 8, and an object on which the image is formed is not limited to a sheet of paper but includes a sheet-shaped member that can be conveyed, such as an overhead projector (OHP) sheet. The medium represents a member to which ink or other liquid for forming an image can adhere. The medium will also be denoted as a recordable medium, recording medium, recording paper, a recording sheet, or the like. In addition, recording, letter printing, imaging, printing, etc. are also used as a synonym for "image formation".

Therefore, in the present specification, the "image forming apparatus (inkjet printer)" of the liquid ejection recording system represents a device that ejects a liquid to a recordable medium such as a sheet, thread, fiber, cloth, leather, metal, plastic, glass, wood, or ceramics so as to form an image.

"Image formation" is not limited to imparting an image having meaning such as characters and graphics to a medium, but also represents imparting an image having no meaning such as a pattern or the like to a medium (simply applying droplets onto a medium).

In addition, the term "ink" in the present specification is not limited to what is generally referred to as ink, but also includes a substance that turns into liquid at ejection so as to be able to be ejected via a recording head. Accordingly, examples of ink include a deoxyribonucleic acid (DNA) sample, a resist, and a pattern material.

In addition, the term "image" is not limited to a planar image but includes an image formed on a stereoscopic object, or an image formed by three-dimensionally shaping a solid object.

In the liquid ejection type image forming apparatus, image formation by an ink jet method in particular has been rapidly spreading in recent years because of its advantages of low noise and low running cost, and easy colorization. However, formation of an image on a substrate other than a dedicated sheet involves disadvantages related to image fastness such as water resistance and weather resistance, in addition to primary quality related disadvantages such as bleeding, density, color tone, and show-through, and thus, suggestions have been made to cope with these disadvantages.

Solutions of these problems include a method of applying a pretreatment liquid having an ink agglomerating function before ink droplets land on a sheet as a recording medium so as to improve the image quality. There is a known method of using a roller to apply the pretreatment liquid to the entire surface of the medium as a method of applying the pretreatment liquid.

Next, the coating device 12 included in the pretreatment liquid coater 120 according to the present embodiment will be described. The coating device 12 is the liquid coating device according to an embodiment of the present disclosure. First, a basic structure of the coating device 12 will be described with reference to FIG. 3. Thereafter, a characteristic structure according to the present embodiment will be described below with reference to other drawings. Comparison between the configuration clearly illustrated in FIG. 3 and the configuration illustrated in the other drawings illustrating a characteristic configuration to be described below would clarify an effect in the present embodiment.

The coating device 12 has a configuration including a squeeze roller 6, a wring roller 5, and an intermediate roller 4 each constituting a supply roller, being arranged in a multistage form inside a pretreatment liquid supply pan 18 which is a liquid supply case to store the pretreatment liquid 7. In addition, a portion above the intermediate roller 4 includes an coating roller 2, a pressure roller 9, and a support roller 10 being arranged in multiple stages. That is, the coating device 12 has a multi-stage roller assembly including a plurality of rollers in a vertical direction.

A part of the outer periphery of the squeeze roller 6 is immersed in the pretreatment liquid 7 stored in the pretreatment liquid supply pan 18. The squeeze roller 6 is held in a positional relationship coming in contact with the pretreatment liquid 7. The squeeze roller 6 corresponds to a first supply roller that draws up the pretreatment liquid 7 from a liquid storage portion.

The wring roller 5 is arranged above the squeeze roller 6. The outer peripheral surfaces of the squeeze roller 6 and the wring roller 5 are held to come in contact with each other by the pressing force from the intermediate roller 4. The wring roller 5 corresponds to a second supply roller that equalizes the amount of the pretreatment liquid 7 drawn up by the squeeze roller 6 to be applied to the sheet 8 on the coating roller 2.

The intermediate roller 4 is disposed above the wring roller 5. The intermediate roller 4 is held with its outer peripheral surface separated from the wring roller 5, and comes in contact with the wring roller 5 when a pressing force is applied by the coating roller 2 as described below. The coating roller 2 corresponds to a third supply roller that supplies the pretreatment liquid 7 equalized by the wring roller 5 to the coating roller 2.

The squeeze roller 6, the wring roller 5, and the intermediate roller 4 are individually held at predetermined positions via rotation shafts, with a gear being provided on each of the rotation shafts. Each of the gears is in contact with a gear on the adjacent roller side, and pivoting operation of one gear provokes pivoting operation of the other gear. The coating device 12 includes a motor 20 as a drive source for the squeeze roller 6. The driving force from the motor 20 rotates the squeeze roller 6, and this causes the gear provided on the rotation shaft to rotate the gear on the wring roller 5 side, leading to rotation of the wring roller 5. When the wring roller 5 rotates, a pivotal force is transmitted to the intermediate roller 4 via the gear of the rotation shaft of the wring roller 5, leading to rotation of the intermediate roller 4.

Rotation of the squeeze roller 6 allows the pretreatment liquid 7 to be attached to the outer peripheral surface of the roller to be drawn up, and then, the pretreatment liquid 7 picked up by the rotation of the squeeze roller 6 is transmitted by the pivotal force of the squeeze roller 6 so as to be attached to the entire longitudinal direction of the outer circumferential surface of the wring roller 5. At this time, the outer peripheral surfaces of the wring roller 5 and the intermediate roller 4 are rotating while being in contact with each other, allowing the wring roller 5 to transfer the pretreatment liquid 7 to be applied over the entire longitudinal direction of the outer peripheral surface of the intermediate roller 4. In this manner, the pretreatment liquid 7 drawn up by the squeeze roller 6 reaches the intermediate roller 4 via the wring roller 5.

The coating roller 2 disposed above the intermediate roller 4 is rotationally driven by a motor 16. This rotational driving conveys the sheet 8 held between the pressure roller 9 and the coating roller 2. The gear provided on the rotation shaft of the coating roller 2 and the gear provided on the rotation shaft of the pressure roller 9 are in contact with each other. The gear on the pressure roller 9 side and the gear on the rotation shaft of the support roller 10 are in contact with each other. Therefore, the driving force from the motor 16 is turned into the driving force of the pressure roller 9 and the support roller 10 via the gears.

The pressure roller 9 and the support roller 10 are disposed in a pressing unit 121. The pressure roller 9 and the support roller 10 has a structure of moving up and down in pairs, and a structure of using the motor 17 to control pressure against the coating roller 2. Further, the pressing unit 121 has a structure of pivoting about the rotation shaft 11 as a rotation shaft. At the time of execution of the image forming processing with operation of the print system 100, the motor 17 is activated before the sheet 8 reaches the pretreatment liquid coater 120, so as to press the support roller 10 and the pressure roller 9 toward the coating roller 2 Side. In the pressing, the support roller 10 holds the pressure roller 9 from above in order to prevent flexure of the pressure roller 9 in the longitudinal direction.

The coating roller 2 is pressed against the intermediate roller 4 by the pressing unit 121. The motor 16 rotates the coating roller 2, and this rotation allows the pretreatment liquid 7 attached to the outer periphery of the intermediate roller 4 to be attached to the entire portions in the longitudinal direction. The sheet 8 is sandwiched between the coating roller 2 pressed by the pressing unit 121 and the pressure roller 9 directly pressing the coating roller 2. Accordingly, the sheet 8 is conveyed with one side being pressed against the coating roller 2. At this time, one side of the sheet 8 is coated with the pretreatment liquid 7. The above is the basic configuration of the coating device 12 that coats the sheet 8 with the pretreatment liquid 7.

Note that the pretreatment liquid supply pan 18 has a structure of using the driving force of the motor 19 to move in the vertical direction (arrangement direction of the squeeze roller 6, the wring roller 5, and the intermediate roller 4 constituting the supply roller). The pretreatment liquid supply pan 18 is controlled to move up and down in accordance with the amount of pretreatment liquid 7 stored and the amount of the pretreatment liquid 7 supplied to the coating roller 2 via the squeeze roller 6. The pretreatment liquid supply pan 18 includes the liquid storage portion to store the pretreatment liquid 7.

The intermediate roller 4 is secured to a frame (casing) constituting the coating device 12, and receives the pressure of the support roller 10, the pressure roller 9, the coating roller 2 disposed at the upper portion, and the pressure of the wring roller 5, and the squeeze roller 6 disposed at the lower portion.

The sheet 8 carried in from the feeder 110 enters between the coating roller 2 and the pressure roller 9 by the conveyance roller while being sandwiched between an entrance upper guide plate 13 and an entrance lower guide plate 1. The sheet 8 is guided by the entrance upper guide plate 13 and the entrance lower guide plate 1 to a position in which the sheet 8 is sandwiched between the coating roller 2 and the pressure roller 9. That is, the entrance upper guide plate 13 and the entrance lower guide plate 1 correspond to a guide constituted by an upper guide plate and a lower guide plate. The entrance upper guide plate 13 and the entrance lower guide plate 1 regulate the upward and downward movement of the sheet 8 in a vertical direction orthogonal to the conveyance direction, thus preventing the sheet 8 from coming off the conveyance path.

The coating roller 2 is rotated by the drive of the motor 16. At this time, the driving force is transmitted from the gear provided on the rotation shaft of the coating roller 2 to the gear provided on the rotation shaft of the pressure roller 9, and the driving force is then transmitted from the gear of the pressure roller 9 to the gear on the rotation shaft of the support roller 10. Gears are installed so that the rotation direction of the coating roller 2 and the pressure roller 9 are opposite to each other. Accordingly, the sheet 8 guided by the entrance upper guide plate 13 and the entrance lower guide plate 1 to reach a portion between the coating roller 2 and the pressure roller 9 receives a conveying force directed in the conveyance direction by these rotations of the rollers.

The portion on the downstream side in the conveyance direction with respect to the coating roller 2 includes a guide claw 3. The guide claw 3 is arranged to promote separation of the sheet 8 from the coating roller 2 at the time of conveyance of the sheet 8, which is nipped by the coating roller 2 and the pressure roller 9 and on which the pretreatment liquid 7 has been applied, in the conveyance direction. That is, the guide claw 3 is provided to promote smooth movement of the sheet 8 separated from the coating roller 2 by self stripping toward a portion between an exit upper guide plate 15 and an exit lower guide plate 14.

The guide claw 3 is disposed at a position not in contact with the outer peripheral surface of the coating roller 2. The guide claw 3 is a claw-shaped member that is held in a "non-contact state" of not being in contact with the outer periphery of the coating roller 2 conveying the sheet 8. That is, the guide claw 3 constitutes a first separator. The guide claw 3 is provided in plurality in the longitudinal direction of the coating roller 2. It is sufficient that the number and arrangement interval are set to be the number and arrangement interval enabling achievement of the function of the guide claw 3.

A certain size of gap is formed between the guide claw 3 and the outer peripheral surface of the coating roller 2. This gap is formed due to a state of each of the guide claws 3 being held by a stopper and an elastic member. Normally, the sheet 8 coated with the pretreatment liquid 7 by the coating roller 2 moves with its leading end in the conveyance direction going along the upper outer surface of the guide claw 3. Accordingly, the sheet 8 is smoothly guided from the coating roller 2 to the portion between the exit upper guide plate 15 and the exit lower guide plate 14. Thereafter, the sheet 8 is transferred to the printer 130 by the conveyance device.

Figure 3:
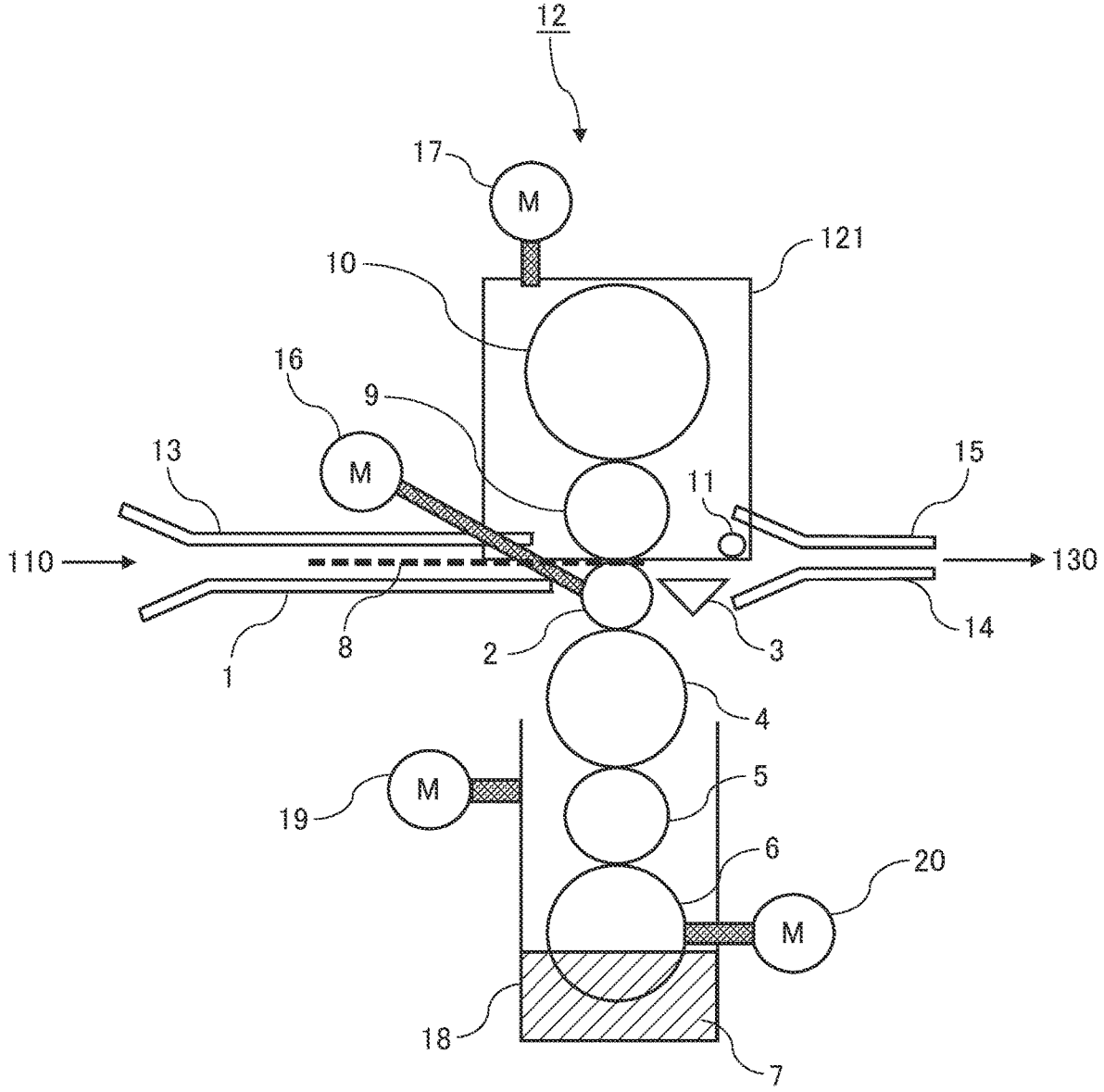
FIG. 3 is a schematic view of an example of a coating device according to an embodiment of the present disclosure.

Next, an example in which the sheet 8 is wound around the coating roller 2 in the coating device 12 having the configuration illustrated in FIG. 3 will be described.

Figure 4:
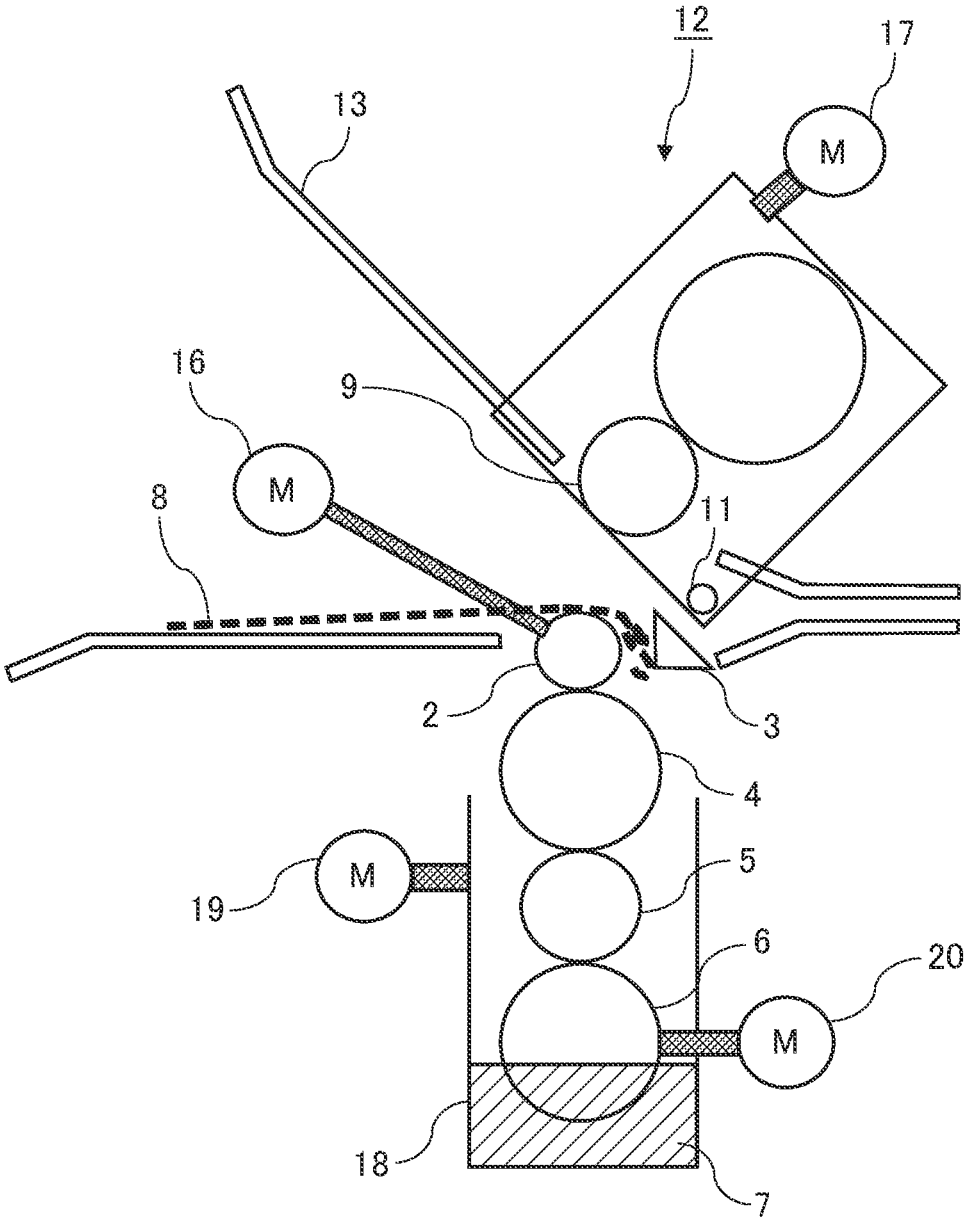
FIG. 4 is a schematic view of a state of removing a sheet wound around an coating roller in the coating device of FIG. 3.

FIG. 4 illustrates the sheet 8 wound onto the coating roller 2 without being separated from the coating roller 2 and having its leading end directed in a direction different from the conveyance direction. As illustrated in FIG. 4, pivoting the pressing unit 121 pivotable about the rotation shaft 11 to upwardly pivot the entrance upper guide plate 13 attached to the pressing unit 121 side would produce a large opening between the entrance lower guide plate 1 and the entrance upper guide plate 13. This exposes the space between the pressure roller 9 and the coating roller 2, making it easy to access the sheet 8 wound around the coating roller 2. As described above, the coating device 12 has a structure capable of easily removing the sheet 8 wound around the coating roller 2.

Pivoting the pressing unit 121 produces a large opening, that is, the gap between the guide claw 3 pressed against the coating roller 2 side and the coating roller 2. This state facilitates the removal of the sheet 8 wound around the coating roller 2, with no hindrance from the guide claw 3.

Figure 5:
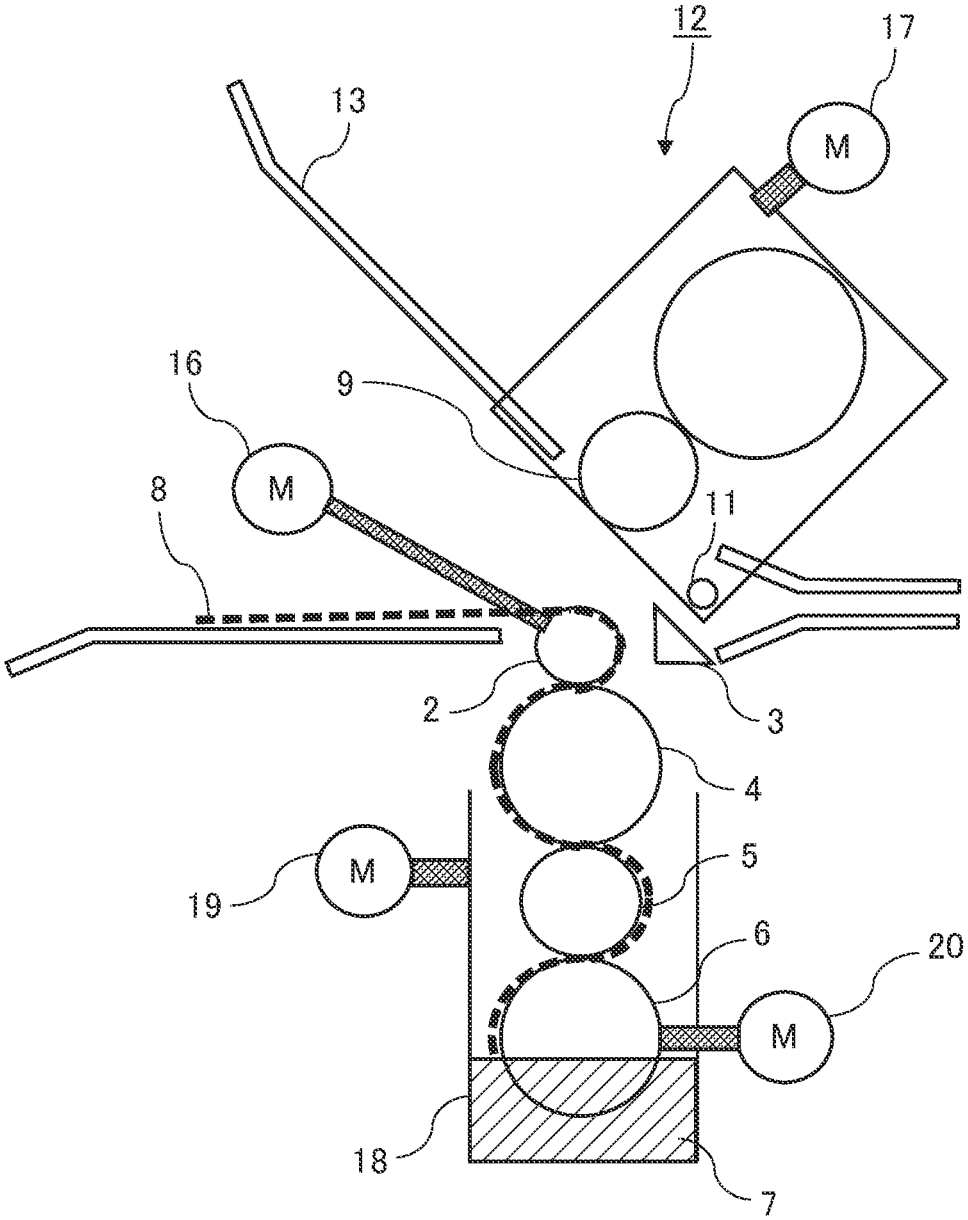
FIG. 5 is a schematic view of a state where a sheet is wound around a supply roller side in a coating device according to a comparative example.

A case where the sheet 8 wound around the coating roller 2 further enters the inside of the coating device 12 will be described with reference to FIG. 5. FIG. 5 illustrates a state where the sheet 8 wound around the coating roller 2 has slipped through the guide claw 3, has not been separated from the coating roller 2, and has reached the intermediate roller 4, the wring roller 5, up to the squeeze roller 6. Even in the state as illustrated in FIG. 5, it is possible, in some cases, to pivot the pressing unit 121 to expose the coating roller 2 to make the coating roller 2 easily accessible, making it possible to pull up and remove the sheet 8 wound around the coating roller 2.

In this case, pulling the sheet 8 which can be a thin sheet having low rigidity, for example, toward the upper portion of the coating roller 2 with the pretreatment liquid 7 attached might tear the sheet 8 in the middle of conveyance (for example, between the intermediate roller 4 and the wring roller 5). In this case, a piece or pieces of the sheet 8 would remain in an unremovable state in one or more of the supply rollers (intermediate roller 4, wring roller 5, and the squeeze roller 6). In this manner, removal of the sheet 8 wound around the supply roller would need disassembly cleaning or the like, making it difficult to instantly remove the sheet 8.

The coating device 12 according to the present embodiment has a structure capable of easily removing the sheet 8 wound around a portion of the supply roller even when the sheet 8 wound around the coating roller 2 has slipped through the guide claw 3. This characteristic structure will be described with reference to FIG. 6.

Figure 6:
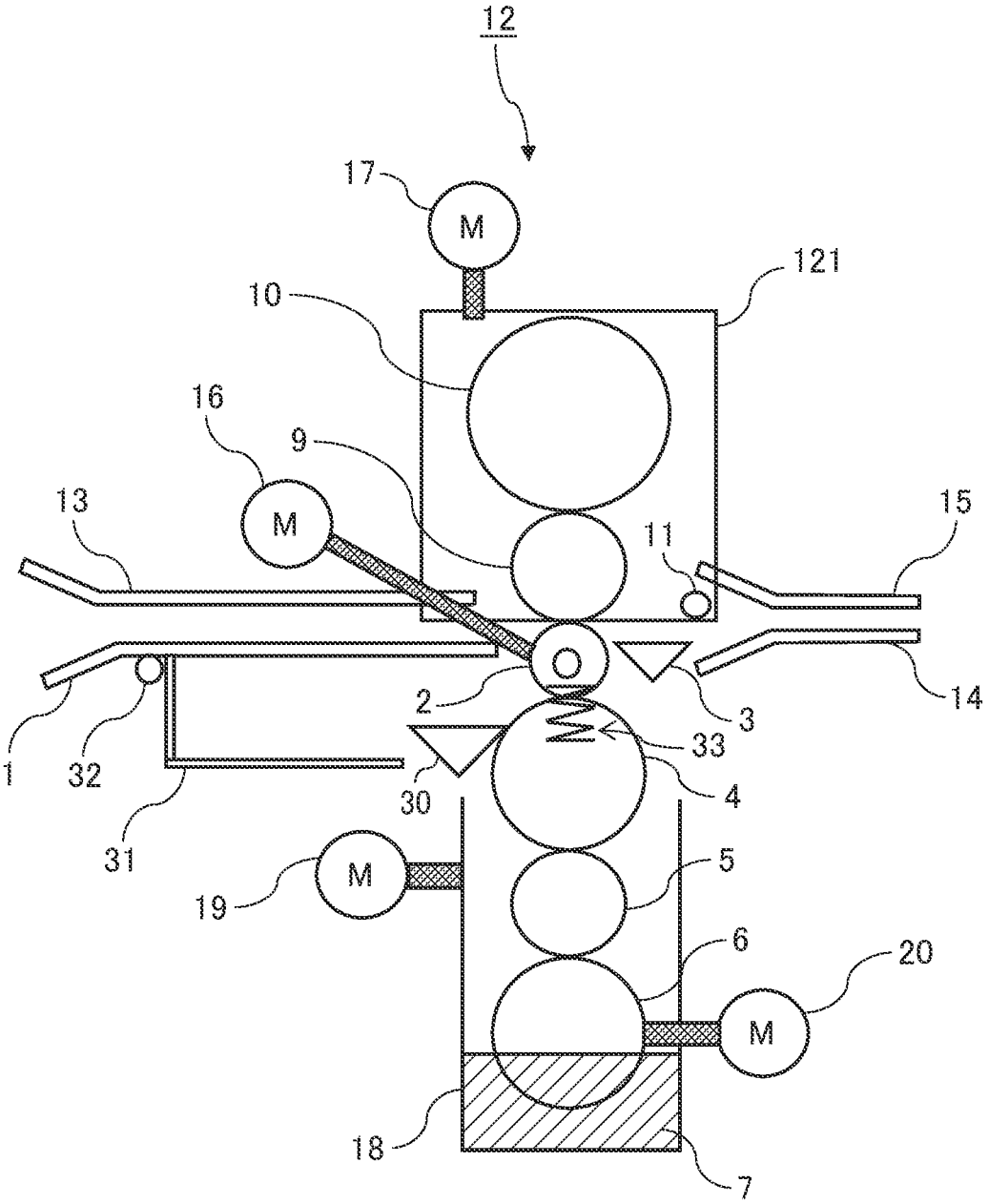
FIG. 6 is a schematic view of a configuration of a coating device as a liquid coating device according to an embodiment of the present disclosure.

As illustrated in FIG. 6, the coating roller 2 is biased in a direction away from the intermediate roller 4 constituting the supply roller, by an elastic member 33 such as a spring secured to the body side of the coating device 12 or the pretreatment liquid coater 120. In other words, the coating roller 2 has a structure of being biased by the elastic member 33 in the direction of arrangement of the pressure roller 9 so as to be pushed up in the upper direction of the pretreatment liquid supply pan 18. As described above, the pressing unit 121 pivots in a direction away from the coating roller 2 about the rotation shaft 11. At this time, the pressure from the pressure roller 9 to the coating roller 2 is in a released state. In the pressure-released state, the coating roller 2 moves away from the intermediate roller 4 by the biasing force applied from the elastic member 33 to the coating roller 2.

When the pressure from the pressing unit 121 to the coating roller 2 is not applied (pressure-released state), the intermediate roller 4 is separated from the coating roller 2. The intermediate roller 4 is secured to the frame, and thus, held in a state of maintaining a certain distance when the pressure from the coating roller 2 is lost.

The guide claw 3 has a structure rotatable in a direction away from the coating roller 2 about a predetermined rotation shaft.

Furthermore, as illustrated in FIG. 6, a separation claw 30 is disposed in the vicinity of the upstream side in the conveyance direction of the intermediate roller 4. The separation claw 30 is a claw-shaped member that is in contact with the outer peripheral surface of the intermediate roller 4 and is pressed against the outer peripheral surface of the intermediate roller 4 by an elastic member. Note that the separation claw 30 is arranged in plurality in the longitudinal direction of the intermediate roller 4, being biased by the elastic member in each of the separation claws 30. Therefore, the plurality of separation claws 30 is in contact with the outer periphery of the intermediate roller 4 during rotation of the intermediate roller 4. That is, the separation claw 30 constitutes a second separator.

A receiver 31 is attached on the upstream side of the separation claw 30 in the conveyance direction and below the entrance lower guide plate 1. The receiver 31 has a size larger than the maximum dimension of the sheet 8 used in the print system 100 in the direction orthogonal to the conveyance direction (width direction of the sheet 8). The receiver 31 forms a storage space to accommodate the sheet 8 that has not been separated by the coating roller 2, being caught up to the intermediate roller 4 side, that is about to be caught along the outer peripheral surface of the intermediate roller 4, and then separated by the separation claw 30. That is, the receiver 31 constitutes a sheet receiver to accommodate at least a portion of the sheet 8.

In the normal operation state, pivoting of the entrance upper guide plate 13 by the pivoting operation of the pressing unit 121 would produce a large opening between the entrance lower guide plate 1 and the entrance upper guide plate 13. In this state, the entrance lower guide plate 1 has a structure of rotating 180° or more toward the upstream side in the conveyance direction about a rotation shaft 32.

Next, a state in which the sheet 8 cannot be separated from the coating roller 2 and is caught on the supply roller side in the coating device 12 according to the present embodiment will be described with reference to FIG. 7.

In normal conveyance in which the sheet 8 is not wound around the coating roller 2 at the coating device 12, the sheet 8 is sandwiched between the coating roller 2 and the pressure roller 9 so as to be transferred in the direction of the upstream entrance upper guide plate 13 and the entrance lower guide plate 1. Thereafter, the sheet 8 is transferred while being sandwiched between the coating roller 2 and the intermediate roller 4. The sheet 8 separated from the coating roller 2 by self stripping is prompted to move by the guide claw 3 to a position between the exit upper guide plate 15 and the exit lower guide plate 14.

The pressure roller 9 is a roller having irregularities on its surface so as to suppress adhesion of the pretreatment liquid 7 to the sheet 8 after adhesion of the pretreatment liquid 7 to the roller. This would not allow the sheet 8 to wind around the pressure roller 9 side and instead, causes the sheet 8 to wind around the coating roller 2 side. Accordingly, the guide claw 3 is disposed simply on the downstream side of the coating roller 2.

However, in the case of using the sheet 8 having a low rigidity such as a thin sheet, the pretreatment liquid 7 might be wound around the coating roller 2 side to which the pretreatment liquid 7 has adhered and might further stick to the intermediate roller 4 side to which the pretreatment liquid 7 adheres.

A detection sensor 35 is disposed on the upstream side in the conveyance direction of the coating roller 2, and a detection sensor 36 is disposed on the downstream side in the conveyance direction of the coating roller 2. A winding detection sensor 37 is disposed at a position downstream of the coating roller 2 in the conveyance direction, between the coating roller 2 and the intermediate roller 4.

In normal conveyance of the sheet 8 coated with the pretreatment liquid 7 in the coating roller 2, the detection sensor 36 detects the sheet 8 within a certain time after the detection of the sheet 8 with the detection sensor 35. In contrast, in a case where the sheet 8 is not detected by the detection sensor 36 within a certain time for any unknown reason, it is possible to determine that an abnormality has occurred in the conveyance of the sheet 8. In this case, a controller stops pivoting of the conveyance roller on the basis of the detection results of the detection sensor 35 and the detection sensor 36, and then stops operation of the motor 16, the motor 20, and the motor 17 as well. This consequently stops the conveyance of the sheet 8.

In a case where the sheet 8 could not be detected within a certain time because the sheet 8 is wound around the coating roller 2, the motor 16 and the motor 20 are operating during the period from the detection of the sheet 8 by the detection sensor 35 until abnormality determination is made by a failure of detection of the sheet 8 by the detection sensor 36. While the motors are operating, the coating roller 2 pivots to push the sheet 8 out in the conveyance direction. The supply rollers also continue to pivot individually during the motor operation. That is, the operation of the sheet 8 of winding around the coating roller 2 and of being capable of winding around the supply roller continues. In this case, when the sheet 8 is wound around the coating roller 2 and is moving toward the intermediate roller 4 side, the winding detection sensor 37 detects the sheet 8.

Accordingly, when the winding detection sensor 37 has detected the sheet 8 even within a certain time, the operation of the motor 16 and the motor 20 may be stopped. Even in that case, the sheet 8 advances to wind around the intermediate roller 4 to some extent. This leads to a possibility of occurrence of movement of the sheet 8 winding from the coating roller 2 to the intermediate roller 4 then to the wring roller 5 during the time lag until stoppage of the operation of the motor 16 and the motor 20.

To handle this, the coating device 12 according to the present embodiment includes the separation claw 30 to come in contact with the outer peripheral surface of the intermediate roller 4. The separation claw 30 is disposed on the upstream side in the conveyance direction with respect to the intermediate roller 4. When the sheet 8 is conveyed to the intermediate roller 4 in a state of being wound around the coating roller 2, the sheet 8 is separated from the intermediate roller 4 by the separation claw 30 and guided to the receiver 31 which is the sheet receiver.

Therefore, the separation claw 30 prevents the sheet 8 from being conveyed to the rollers (the wring roller 5 and the squeeze roller 6) following the intermediate roller 4, and guides the sheet 8 to the receiver 31 having a structure capable of easily removing the sheet 8.

The separation claw 30 corresponds to a second separator that can come in contact with the supply roller and is formed with a component fabricated with a resin material or the like. The intermediate roller 4 is formed of a metal material such as a stainless steel. This suppresses occurrence of scratches caused by the separation claw 30 on the outer peripheral surface (surface on which the pretreatment liquid 7 adheres) of the intermediate roller 4 or suppresses unevenness of the pretreatment liquid 7.

Figure 7:
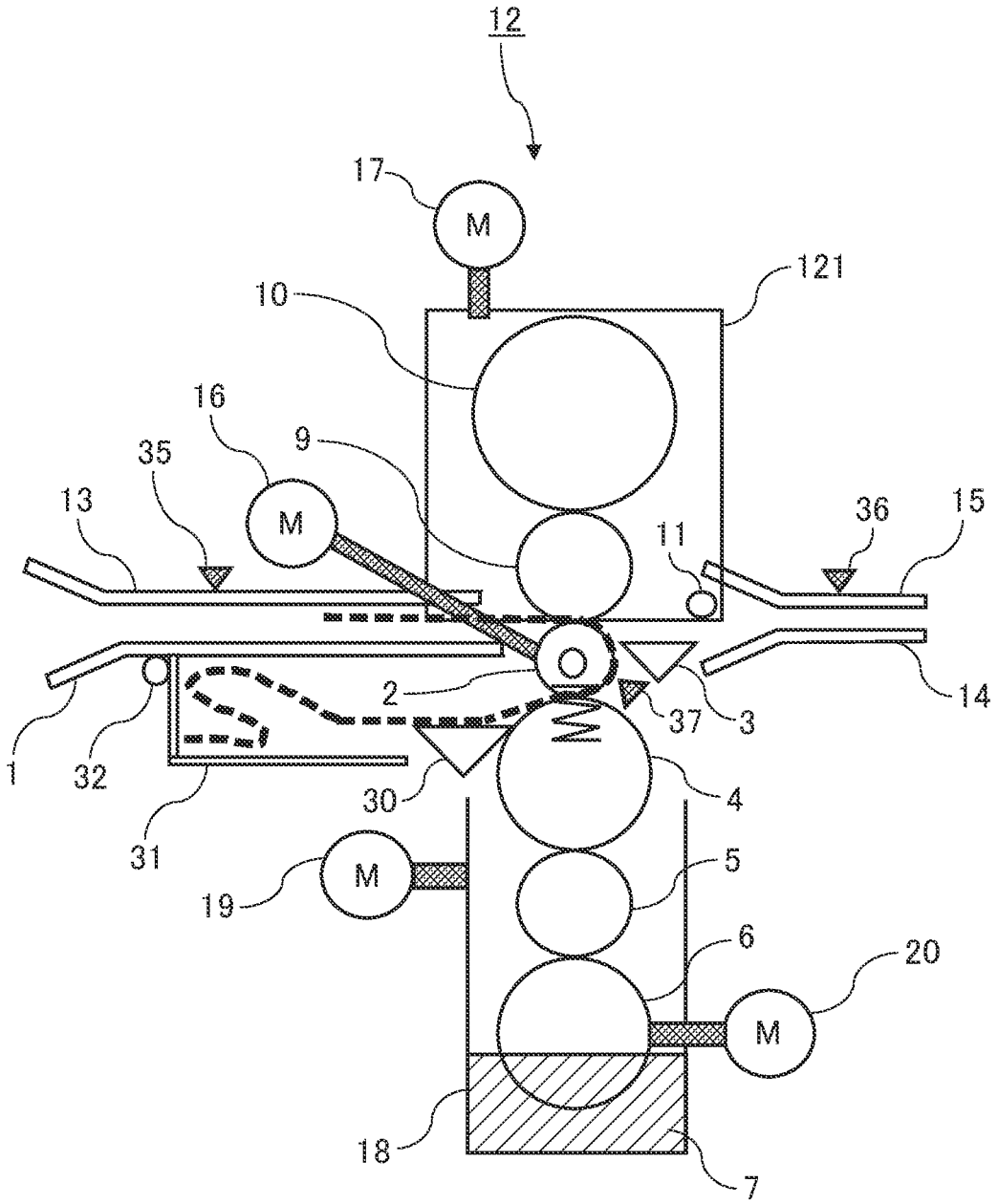
FIG. 7 is a schematic view of a state where a sheet wound around an coating roller in the coating device of FIG. 6 is transferred to a sheet receiver.

As illustrated in FIG. 7, when the sheet 8 is not normally separated from the coating roller 2 and remains wound around the coating roller 2, the sheet 8 reaches the intermediate roller 4 side. Even in such a state, as illustrated in FIG. 8, the coating device 12 according to the present embodiment is capable of easily extracting the sheet 8.

Figure 8:
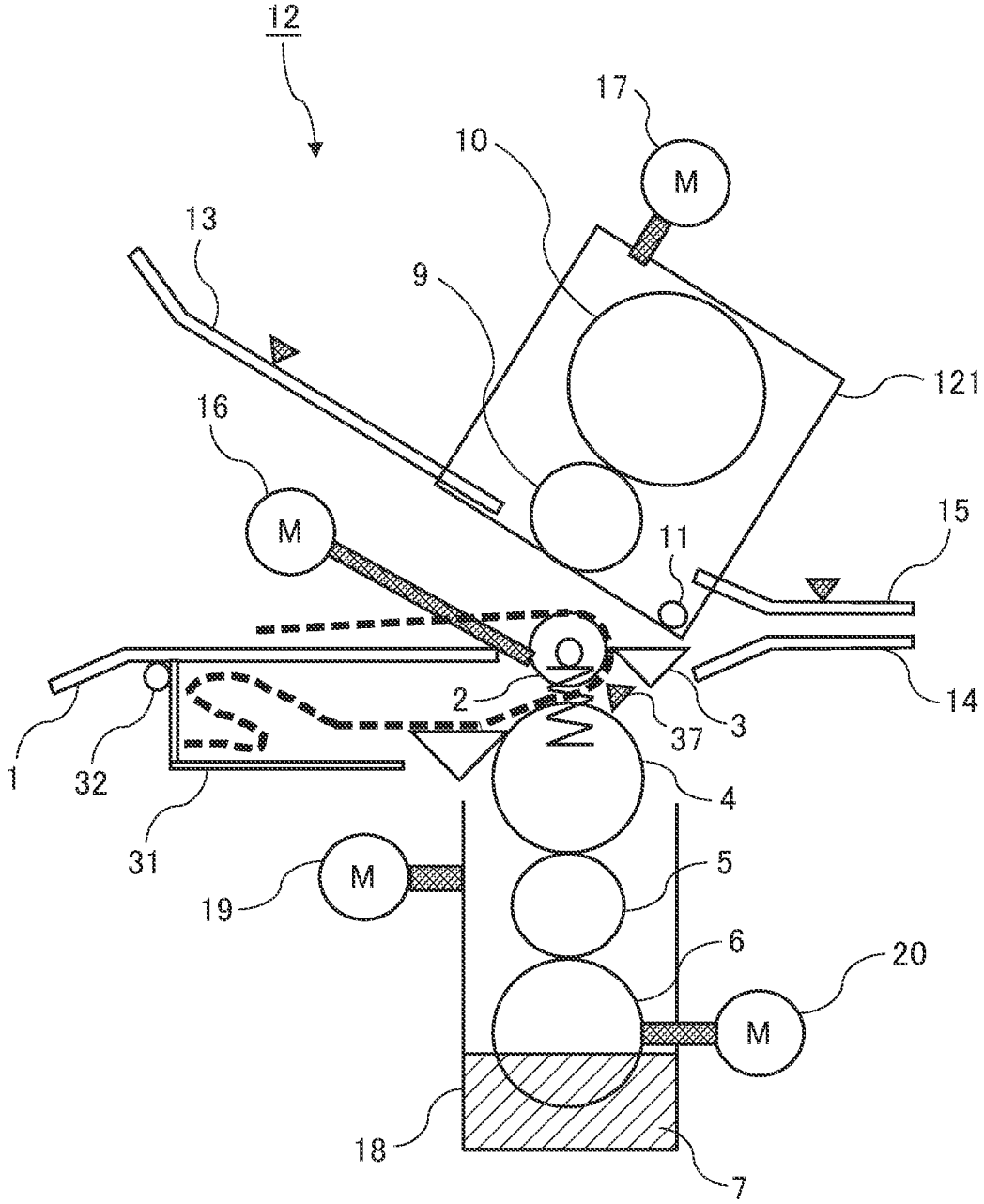
FIG. 8 is a schematic view of a state of removing the sheet wound around the coating roller in the coating device of FIG. 6.

As illustrated in FIG. 8, the structure between the entrance lower guide plate 1 having the receiver 31 and the entrance upper guide plate 13 as a counter member of the entrance lower guide plate 1 is capable of opening widely. Detection of winding of the sheet 8 by the winding detection sensor 37 leads to the stoppage of the operation of the coating device 12. Thereafter, pivoting the pressing unit 121 about the rotation shaft 11 also pivots the entrance upper guide plate 13 joined to the pressing unit 121 about the rotation shaft 11 to be moved upward. This operation can widely open and expose the upper portion of the coating roller 2, enabling removal of the sheet 8 from the upper portion.

In this case, however, it is still difficult to remove all of the sheet 8 from the upper portion alone in a case where the sheet 8 is wound up to the intermediate roller 4 side. In a case where the sheet 8 is a thin sheet or the like, in particular, the pretreatment liquid 7 tends to adhere and the sheet 8 would be torn more easily. An attempt to forcibly pulling out the sheet 8 from the top would tear the sheet 8 in the middle, leading to a failure in removing the sheet 8 easily. To manage this, the pressing unit 121 is pivoted to eliminate the pressure from the pressure roller 9 to the coating roller 2, so as to move the coating roller 2 upward by using the action of the elastic force of the elastic member 33. This forms a gap between the coating roller 2 and the intermediate roller 4, and the state shifts from the contact state to the separated state as in operation. This would release the sheet 8 wound up to the intermediate roller 4 side from the state of being sandwiched between the coating roller 2 and the intermediate roller 4, leading to easy removal of the sheet 8.

Even when the sheet 8 is wound around the intermediate roller 4, the sheet 8 can be separated from the intermediate roller 4 and discharged toward the receiver 31 by the contact-type separation claw 30. This suppresses occurrence of winding and strong adhesion of the sheet 8 around the intermediate roller 4, making it easy to remove the sheet 8.

Figure 9:
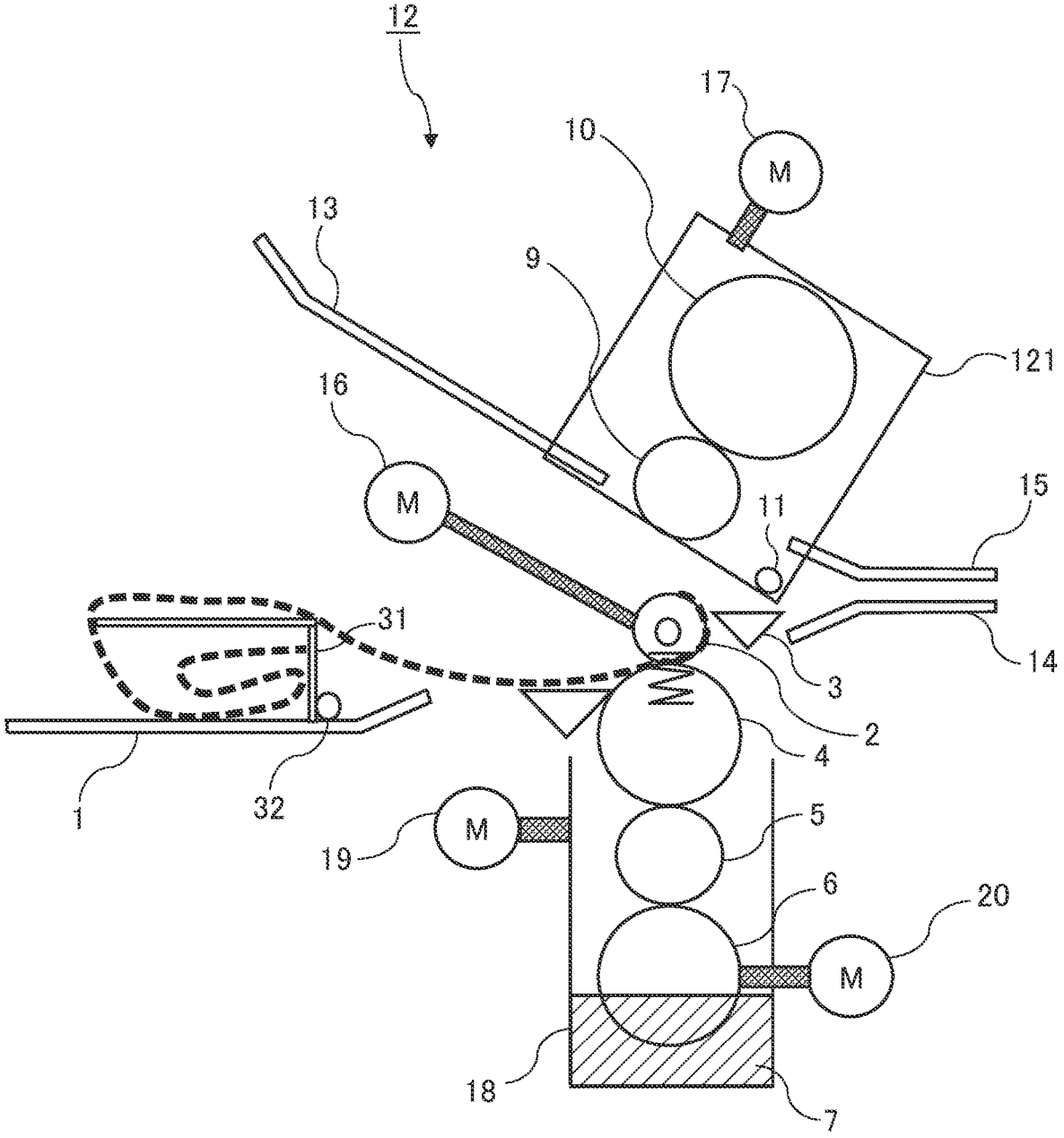
FIG. 9 is a schematic view of a state of removing the sheet wound around the supply roller in the coating device of FIG. 6.
Figure 10:
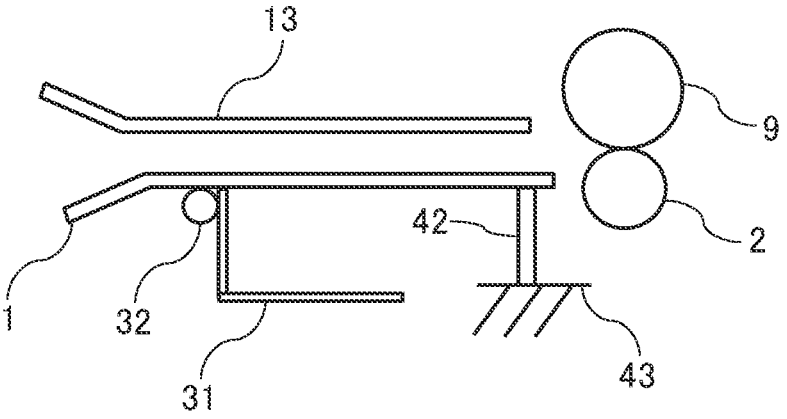
FIG. 10 is a schematic view of an adjuster of adjusting the entrance angle of a sheet included in the coating device of FIG. 6.

Furthermore, as illustrated in FIG. 8, the sheet 8 separated from the intermediate roller 4 and discharged to the receiver 31 can be easily removed from the coating device 12. That is, the entrance upper guide plate 13 pivots together with the pivoting operation of the pressing unit 121, allowing the entrance upper guide plate 13 and the entrance lower guide plate 1 to have a large space between the plates. The entrance lower guide plate 1 has a structure of pivoting 180° or more about the rotation shaft 32. Accordingly, the entrance lower guide plate 1 can be pivoted to shift the receiver 31 to be directed to the upward direction, as illustrated in FIG. 9. When the sheet 8 is stored in the receiver 31, being directed to the upward direction, the storage port is such that its opening faces outward. That is, the sheet 8 can be exposed. This makes it possible to easily extract the sheet 8 from the receiver 31. That is, the sheet 8 wound around the intermediate roller 4 can also be easily removed. Furthermore, this configuration makes it possible to suppress tearing or scattering of the sheet 8 even with the pretreatment liquid 7 in the removal of the sheet 8.

Moreover, unlike operation of feeling around inside the coating device 12, it is possible to easily perform cleaning with care to avoid adhesion of a liquid to a service person or clothes.

The entrance lower guide plate 1 stops at a position to abut against the stopper, when pivoted. The stopper is supposed to be secured to a casing 12*a* of the coating device 12, a housing 120*a* of the pretreatment liquid coater 120, or the like.

With the use of the pretreatment liquid coater 120 according to the present embodiment described above, even when the sheet 8 has not been separated from the coating roller 2 and the sheet 8 is about to be caught into the inside of the coating device 12, it is possible to effectively prevent this so as to be able to uniformly coat the sheet 8 with the pretreatment liquid 7.

Furthermore, even when the sheet 8 is not separated by the coating roller 2 and the sheet 8 is wound around the intermediate roller 4, there is a recovery mechanism provided at a position where the sheet 8 can be easily extracted without allowing the sheet 8 to go deeper.

Since the recovery mechanism has a structure of pivoting 180° or more with the upper portion of the coating device 12 open, it is possible to easily collect and clean the sheet 8, even when the sheet 8 is wound from the coating roller 2 up to the intermediate roller 4.

The coating device 12 according to the present embodiment is installed on the pretreatment liquid coater 120 via a slide rail or the like. That is, the coating device 12 is a liquid coating device mounted on the pretreatment liquid coater 120, and is to be movable to the outside of the pretreatment liquid coater 120. This makes it possible to extract the coating device 12 easily in order to facilitate the work of removing the sheet 8 from the coating device 12. Accordingly, when pivoting the pressing unit 121 to extract the sheet 8 as described above, the coating device 12 is drawn out from the pretreatment liquid coater 120. In this case, the objects to be drawn out are the coating device 12 (including the entrance lower guide plate 1, the entrance upper guide plate 13, the exit lower guide plate 14, and the exit upper guide plate 15). That is, in the state described above with reference to FIG. 4 and thereafter, the operation of pivoting the pressing unit 121 and reversing the entrance lower guide plate 1 is performed in a state where the coating device 12 is drawn out from the pretreatment liquid coater 120. Therefore, it is preferable that the receiver 31 can also be drawn out of the apparatus, together with the coating device 12.

The entrance lower guide plate 1 and the entrance upper guide plate 13 included in the coating device 12 according to the present embodiment forms an entrance-side guide, constituting a conveyance path to guide the sheet 8 to the position between the coating roller 2 and the pressure roller 9. Among the guide plates, the entrance lower guide plate 1 abuts against a member that defines the position at which the sheet 8 enters a nip between the coating roller 2 and the pressure roller 9.

The coating device 12 according to the present embodiment includes a height adjuster capable of adjusting the height of the entrance lower guide plate 1 on the coating roller 2 side. The height adjuster of the entrance lower guide plate 1 includes: an adjustment screw 42 capable of adjusting the height position of the end of the entrance lower guide plate 1 on the side of the coating roller 2; and a secured portion 43 on which the adjustment screw 42 is secured at a predetermined position. The secured portion 43 may be a plane provided on a wall surface inside the housing 120*a* of the pretreatment liquid coater 120 or may be a plane protruding from an outer wall surface of the pretreatment liquid supply pan 18.

The adjustment screw 42 is provided at individual positions corresponding to both end portions in the longitudinal direction of the coating roller 2. The height of the tip portion of the adjustment screw 42 can be changed to adjust the angle at which the sheet 8 enters between the coating roller 2 and the pressure roller 9. Accordingly, adjusting the entrance angle capable of suppressing the occurrence of the winding onto the coating roller 2 can reduce the winding of the sheet 8 onto the roller.

Figure 11:
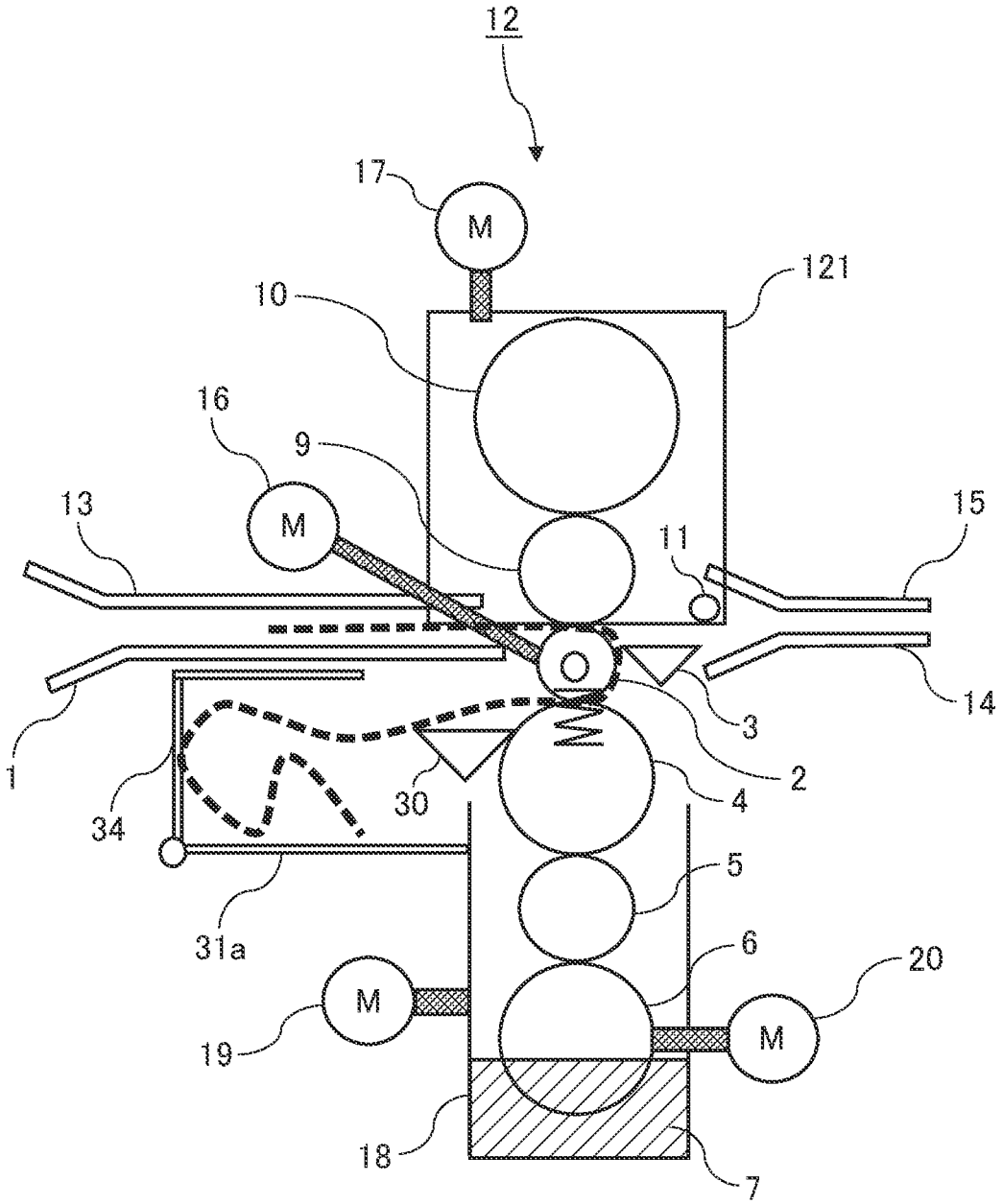
FIG. 11 is a schematic view of a state where a sheet wound around a coating roller in a coating device according to another embodiment is transferred to a sheet receiver.
Figure 12:
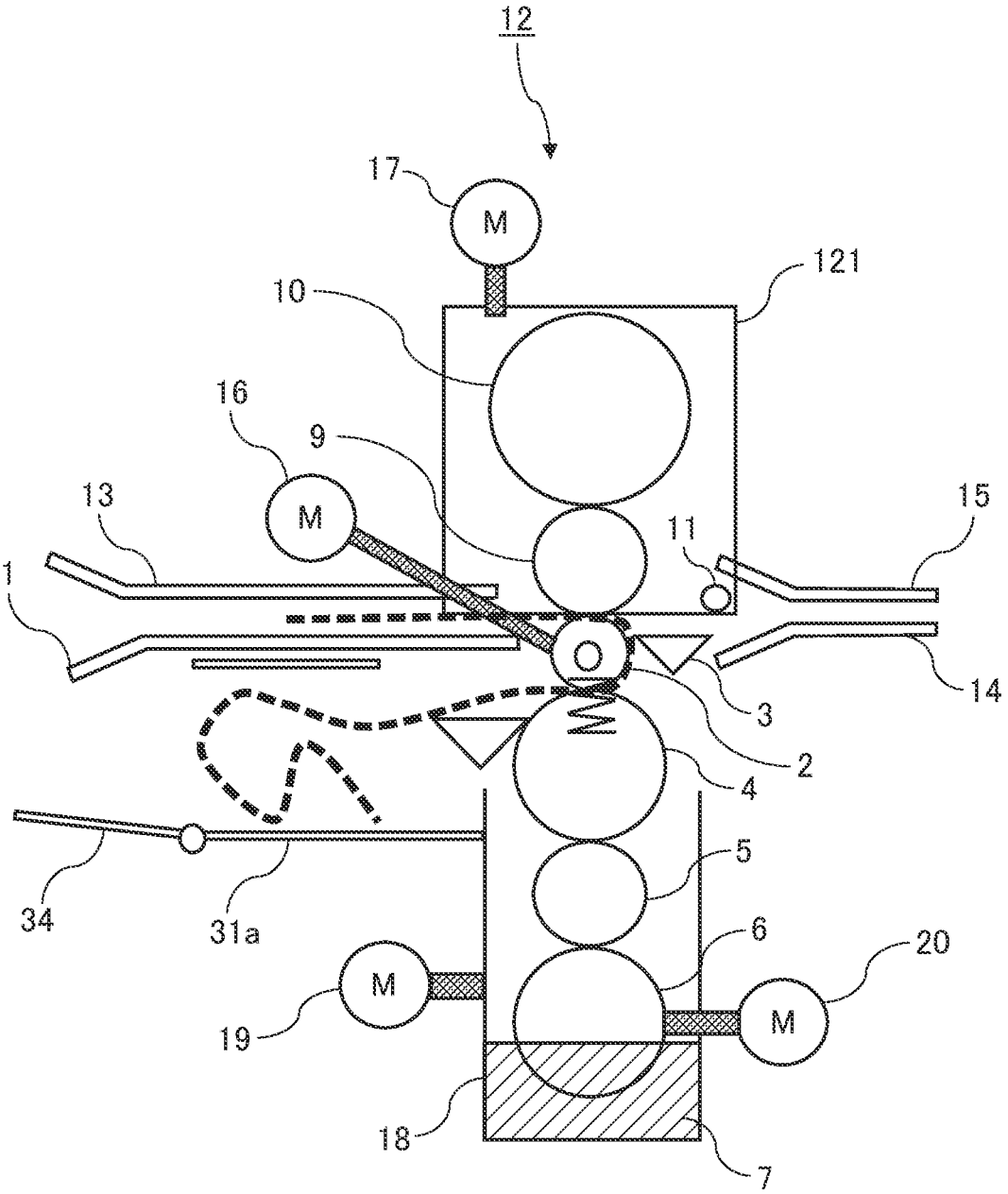
FIG. 12 is a schematic view of a state of removing the sheet wound around the supply roller in the coating device of FIG. 12.

Next, the coating device 12 according to another embodiment of the present disclosure will be described with reference to FIGS. 11 and 12. FIG. 11 and FIG. 12 illustrate an example of the sheet recovery structure of the coating device 12 according to the present embodiment. In the above-described embodiment, the receiver 31 is provided on the entrance lower guide plate 1. The structure to pivot the entrance lower guide plate 1 enables the receiver 31 to be exposed when the sheet 8 is extracted. This structure would use a large space for pivoting operation of the entrance lower guide plate 1 by pivoting the entrance upper guide plate 13.

The coating device 12 according to the present embodiment relates to a structure that facilitates extraction of the sheet 8 wound around the intermediate roller 4 without using a space for pivoting operation of the entrance lower guide plate 1. As illustrated in FIG. 11, in the present embodiment, a receiver 31*a* as the sheet receiver is a box-shaped member secured to the outer wall of the pretreatment liquid supply pan 18. The wall surface on the upstream side in the conveyance direction functions as a door 34 for opening and closing the extraction port.

Even when the sheet 8 which has not been separated from the coating roller 2 attempts to wind around the intermediate roller 4, the sheet 8 would be separated from the intermediate roller 4 by the separation claw 30. The sheet 8 separated from the intermediate roller 4 is thereafter stored in a receiver 31*a* constituting a sheet receiver.

As illustrated in FIG. 12, the door 34 pivots toward the upstream side in the conveyance direction so as to open the extraction port of the sheet 8. This prepares an accessible state to the inside of the receiver 31*a*. As described above, the coating device 12 can be drawn out to the pretreatment liquid coater 120 via the slide rail. Accordingly, opening the door 34 after drawing out the coating device 12 enables easy extraction of the sheet 8.

The invention made by the present inventor has been specifically described on the basis of the above-described example embodiments. The present invention is not limited to the one described in the above embodiments, and various changes may be made without departing from the scope and spirit of the present invention.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid coating device comprising:

a coating roller to coat a sheet with liquid;

a supply roller to supply the liquid to the coating roller;

a pressure roller to sandwich the sheet, together with the coating roller;

a first separator to separate the sheet coated with the liquid, from the coating roller;

a second separator to separate, from the supply roller, a sheet that has not been separated by the first separator and has reached the supply roller;

a sheet receiver forming a storage space to accommodate at least a portion of the sheet that has been separated from the supply roller by the second separator; and a guide to guide the sheet to a position at which the sheet is sandwiched with the coating roller and the pressure roller, wherein the guide includes an upper guide plate and a lower guide plate to regulate movement of the sheet in a vertical direction orthogonal to a conveyance direction of the sheet, and wherein the sheet receiver is disposed on the lower guide plate.

2. The liquid coating device according to claim 1, wherein the first separator is claw-shaped and held without contacting the coating roller, and wherein the second separator is claw-shaped and held in contact with the supply roller.

3. The liquid coating device according to claim 1, wherein the lower guide plate has a structure rotatable about a rotation shaft, and wherein the sheet receiver is rotatable by 180° or more about the rotation shaft.

4. The liquid coating device according to claim 1, wherein the lower guide plate includes an adjuster to adjust an angle at which the sheet enters a portion between the coating roller and the pressure roller.

5. The liquid coating device according to claim 1, further comprising a liquid supply case to accommodate the supply roller, wherein the liquid supply case includes a liquid storage portion to store the liquid, and wherein the sheet receiver is disposed on an outer wall of the liquid supply case.

6. The liquid coating device according to claim 1, further comprising a multi-stage roller assembly includes:

a first supply roller to draw up the liquid from a liquid storage portion;

a second supply roller to equalize an amount of the liquid drawn up to be applied to the sheet on the coating roller; and the supply roller to supply the liquid equalized by the second supply roller to the coating roller.

7. The liquid coating device according to claim 1, further comprising a support roller to support pressing of the pressure roller against the coating roller.

8. The liquid coating device according to claim 1, further comprising an elastic member to bias the coating roller in a direction away from the supply roller, wherein the coating roller is in contact with the supply roller in a state in which the pressure roller is in a pressing state and is not in contact with the supply roller in a state in which the pressure roller is in a pressure-released state.

9. A liquid-coating conveyance apparatus comprising:

the liquid coating device according to claim 1 to coat the sheet with the liquid; and a conveyance device to feed the sheet into the liquid coating device and convey the sheet coated with the liquid.

10. The liquid-coating conveyance apparatus according to claim 9, wherein the liquid coating device is held by a housing of the liquid-coating conveyance apparatus in a state in which the liquid coating device is movable to an outside of the liquid coating device.

11. An image forming system comprising:

an image forming apparatus to form an image on a sheet; and the liquid coating device according to claim 1 to coat the sheet with the liquid.

12. A liquid coating device comprising:

a coating roller to coat a sheet with liquid;

a supply roller to supply the liquid to the coating roller;

a pressure roller to sandwich the sheet, together with the coating roller;

a first separator to separate the sheet coated with the liquid, from the coating roller;

a second separator to separate, from the supply roller, a sheet that has not been separated by the first separator and has reached the supply roller;

a sheet receiver forming a storage space to accommodate at least a portion of the sheet that has been separated from the supply roller by the second separator; and a multi-stage roller assembly including:

a first supply roller to draw up the liquid from a liquid storage portion;

a second supply roller to equalize an amount of the liquid drawn up to be applied to the sheet on the coating roller; and the supply roller to supply the liquid equalized by the second supply roller to the coating roller.

13. The liquid coating device according to claim 12, further comprising a support roller to support pressing of the pressure roller against the coating roller.

14. The liquid coating device according to claim 12, further comprising an elastic member to bias the coating roller in a direction away from the supply roller, wherein the coating roller is in contact with the supply roller in a state in which the pressure roller is in a pressing state and is not in contact with the supply roller in a state in which the pressure roller is in a pressure-released state.

15. A liquid-coating conveyance apparatus comprising:

the liquid coating device according to claim 12 to coat the sheet with the liquid; and a conveyance device to feed the sheet into the liquid coating device and convey the sheet coated with the liquid.

16. The liquid coating device according to claim 15, wherein the liquid coating device is held by a housing of the liquid-coating conveyance apparatus in a state in which the liquid coating device is movable to an outside of the liquid coating device.

17. An image forming system comprising:

an image forming apparatus to form an image on a sheet; and the liquid coating device according to claim 12 to coat the sheet with the liquid.

18. A liquid coating device comprising:

a coating roller to coat a sheet with liquid;

a supply roller to supply the liquid to the coating roller;

a pressure roller to sandwich the sheet, together with the coating roller;

a first separator to separate the sheet coated with the liquid, from the coating roller;

a second separator to separate, from the supply roller, a sheet that has not been separated by the first separator and has reached the supply roller;

a sheet receiver forming a storage space to accommodate at least a portion of the sheet that has been separated from the supply roller by the second separator; and an elastic member to bias the coating roller in a direction away from the supply roller, wherein the coating roller is in contact with the supply roller in a state in which the pressure roller is in a pressing state and is not in contact with the supply roller in a state in which the pressure roller is in a pressure-released state.

19. A liquid-coating conveyance apparatus comprising:

the liquid coating device according to claim 18 to coat the sheet with the liquid; and a conveyance device to feed the sheet into the liquid coating device and convey the sheet coated with the liquid.

20. An image forming system comprising:

an image forming apparatus to form an image on a sheet; and the liquid coating device according to claim 18 to coat the sheet with the liquid.

* * * * *